United States Patent [19]

Mayer et al.

[11] 4,029,446

[45] June 14, 1977

[54] SEALING ARRANGEMENT FOR GEAR-TYPE FLUID DISPLACING MACHINES

[75] Inventors: Siegfried Mayer, Vaihingen; Ivan Sauer, Schwieberdingen; Jürgen Zorn, Korntal, all of Germany

[73] Assignee: Robert Bosch G.m.b.H., Stuttgart, Germany

[22] Filed: Dec. 31, 1975

[21] Appl. No.: 645,880

[30] Foreign Application Priority Data

Jan. 10, 1975 Germany ..... 7500496[U]

[52] U.S. Cl. ..... 418/132; 277/95

[51] Int. Cl.[2] ..... F01C 19/08; F03C 3/00; F16J 15/14

[58] Field of Search ..... 418/131, 132; 415/113, 415/170 A; 277/81 P, 95

[56] References Cited

UNITED STATES PATENTS

| | | | |
|---|---|---|---|
| 2,415,888 | 2/1947 | Joy | 277/95 |
| 2,684,033 | 7/1954 | Montgomery et al. | 415/113 |
| 2,808,785 | 10/1957 | Hilton | 418/132 |
| 3,142,260 | 7/1964 | Oliver | 418/132 |
| 3,228,342 | 1/1966 | Page | 415/113 |
| 3,348,492 | 10/1967 | Olson et al. | 418/131 |
| 3,891,360 | 6/1975 | Dworak | 418/132 |
| 3,909,165 | 9/1975 | Laumont | 418/132 |

FOREIGN PATENTS OR APPLICATIONS

| | | | |
|---|---|---|---|
| 1,940,106 | 3/1971 | Germany | 418/131 |
| 965,256 | 7/1964 | United Kingdom | 418/132 |

*Primary Examiner*—John J. Vrablik
*Attorney, Agent, or Firm*—Michael J. Striker

[57] ABSTRACT

A gear-type fluid displacing machine includes a housing having a chamber and two side sections overlying opposite ends of the chamber, a pair of mating gears in the chamber for generating a high pressure area therein as the gears rotate, and annular bearing members surrounding trunnions associated with the gears at opposite ends of the chamber each of the bearing members having an end which faces one of the side sections of the housing and being formed with a groove. The sealing arrangement includes a generally U-shaped resilient sealing element in each of the grooves and having an open side in communication with the high pressure area. The sealing element has at least one wedge-shaped leg which is pressed into sealing contact with an associated side section by its own resilience and by the force exerted by the pressure fluid entering the open side of the element from the high pressure area.

18 Claims, 11 Drawing Figures

SEALING ARRANGEMENT FOR GEAR-TYPE FLUID DISPLACING MACHINES

BACKGROUND OF THE INVENTION

The present invention relates to gear-type fluid displacing machines, especially to external gear-type hydraulic pumps or motors, and, more particularly, to improvements in the sealing of the housing.

In presently known gear-type machines, high and lower pressure areas are generated within the chamber which houses the rotating gears. It is known to separate these areas from each other by using seals having round, rectangular or a square-shaped configuration. No matter which of these configurations is utilized in a particular application, opposite sides of these prior art seals are clamped and compressed between two parts of the housing.

Such seals present some very serious disadvantages which affect the output and efficiency of the machine. First of all, a considerable clamping force is generally required to provide an effective seal which is operative both under low and high loading conditions of the machine. Thus, the bearing members which engage one side of the seal are strongly urged against the gears so that, even under relatively low pressure conditions, undesirable wear of the gears results.

In addition, the seals of the prior art are generally constituted of rubber material so that after a period of use, it is common for the rubber material to flow away from the clamping portions of the housing. This evidently reduces the sealing effect since the prior art seals, which are originally clamped with an initial tightening force, need to be periodically retightened.

SUMMARY OF THE INVENTION

Accordingly, it is the general object of the present invention to overcome the disadvantages of the prior art.

Another object of the present invention is to improve the sealing of a gear-type machine.

Still another object of the present invention is to provide a sealing arrangement which subjects the gears to minimal wear.

An additional object of the present invention is to provide a long-lasting sealing arrangement which need not be frequently replaced.

Yet another object of the present invention is to increase the effectiveness of the sealing arrangement by increasing the sealing force as a function of the loading of the machine.

Still a further object of the present invention is to provide a sealing arrangement which is economical in operation.

In keeping with these objects and others which will become apparent hereinafter, one feature of the invention resides, briefly stated, in a combination in a gear-type fluid displacing machine which comprises a housing having a chamber and two side sections overlying opposite ends of the chamber. A pair of mating gears is provided within the chamber for generating a high pressure area therein as the gears rotate. Annular bearing members surround trunnions which are associated with the gears at opposite ends of the chamber. Each of the annular bearing members has an end facing one of the side sections of the housing and is further formed with a groove. A sealing element which is generally U-shaped and constituted of resilient material is provided in each of the grooves and has an open side in communication with the high pressure area. The sealing element further comprises at least one wedge-shaped leg which is pressed into sealing contact with an associated side section of the housing by its own resilience and by the force exerted by the pressure fluid which enters the open side of the element from the high pressure area.

This feature overcomes the drawbacks of the prior art in a novel manner. By providing the sealing element with a U-shape and further providing that its open end communicates with the high pressure area, the effectiveness of the sealing arrangement increases directly as a function of the loading condition of the machine. Thus, under no-load or slightly-loaded conditions, the seal is adequately made by the inherent resilience of the sealing element itself. This greatly reduces the wear on the gears.

However, for higher-loaded conditions, the sealing force is proportionately increased since the fluid which enters the open side of the sealing element from the high-pressure area similarly is at a proportionately higher pressure. Thus, in accordance with the invention, the seal does not need frequent replacement.

Another feature of the present invention is embodied in the wedge-shape of the leg which is pressed against the associated side section of the housing. This taper design guarantees that the flow of the entering pressure fluid will be free of turbulence, thus guaranteeing no loss in pressure.

In accordance with yet another feature of the present invention, the sealing element is constituted of synthetic plastic material such as polyamides such as nylon. Such polyamides are resilient and permit undesirable tolerance build ups to be easily remedied.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
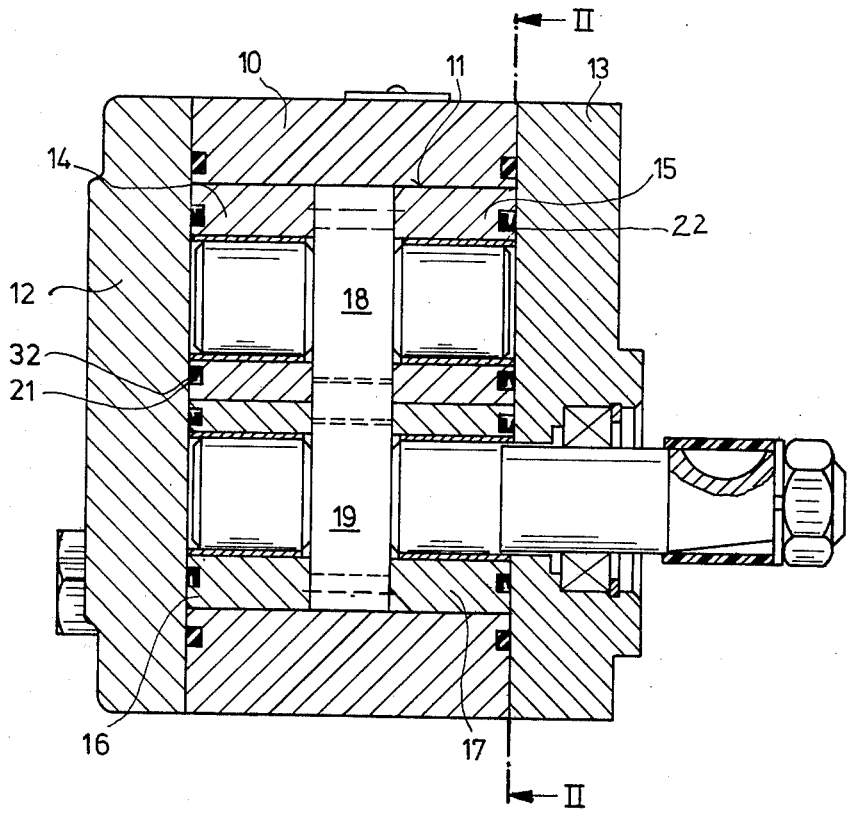
FIG. 1 is a view in vertical section of the gear-type fluid displacing machine in accordance with the present invention.
Figure 2:
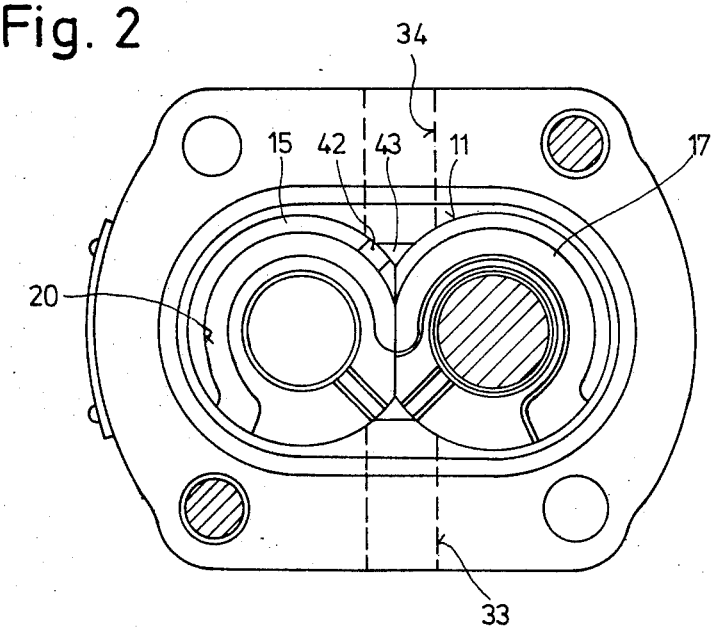
FIG. 2 is a side view along the line in the direction of the arrows II—II of the machine of FIG. 1, with the sealing element removed.

The gear-type fluid displacing machine of FIGS. 1 and 2 may be used either as a pump or as a motor. The machine comprises a housing or body having a main or central section 10 and two outer side sections or covers 12, 13 which are bolted to the main section 10 and which overlie and seal opposite ends of an eight-shaped chamber 11. The chamber 11 consists of two partially overlapping parallel cylindircial bores which are machined into the main section 10.

A pair of mating gears 18 and 19 are received in chamber 11 for generating a high pressure zone or area therein as they rotate. Each bore of the chamber 11 receives two coaxial annular bearing members 14, 15 or 16, 17 which, in turn, surround and receive the trunnions of the gears 18, 19. Intermediate the annular bearing members and the trunnions of the gears, cylindrical sleeves are press-fitted into the respective bearing members to facilitate the rotation of the gears 18 and 19.

The lower trunnion in FIG. 1 has an extension which passes through an opening in cover 13 and is surrounded by a sealing element. The free emd of this extension can be coupled to a prime mover, not shown.

Each of the annular bearing members 14–17 has an end which faces one of said covers 12, 13 and which is respectively formed with grooves 21 and 20. The configurations of both grooves are identical; i.e., top view each groove is shaped as "a three" (see FIGS. 2, 4 or 7), and in cross-sectional view each groove is generally quadrilaterally shaped (see FIG. 1) with its base wall having rounded corners 20′, 20″ (see FIG. 3).

Figure 5:
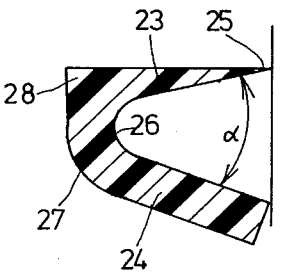
FIG. 5 is a view in cross-section along the line in the direction of the arrows V—V of the sealing ring of FIG. 4.
Figure 4:
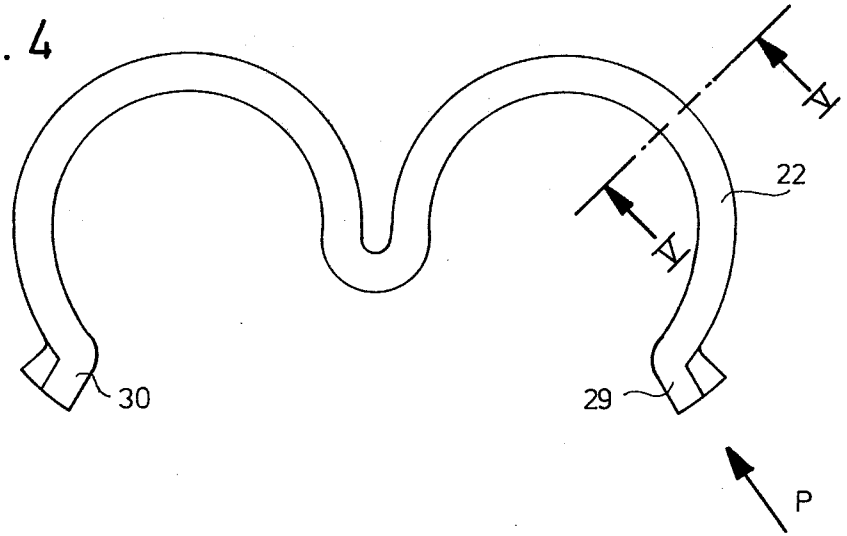
FIG. 4 is a top view of sealing ring.

Within each groove 20 and 21, a generally U-shaped resilient sealing element, as identified by reference numerals 32 and 22, is provided. As best illustrated in FIGS. 4 and 5, the element 22 or 32 has two legs 23 and 24 which are formed in accordance with the art of lip sealing. The legs 23 and 24 meet at a closed end of the U-shaped element to form acute angle $\alpha$.

Leg 23 is preferably linearly tapered on its inner surface from point 25 located at an open end of the resilient element towards the closed end of the latter so as to form a wedge-like shape. Preferably, leg 24 has, but need not have, a quadrilateral cross-section whose thickness is substantially constant intermediate the open and closed ends of the resilient element and whose thickness is also thicker than that of the leg 23.

The inner curved surface 26 of the closed end steplessly joins the inner surfaces of legs 23 and 24 in a smooth curve. The outer surface 27 of the closed end joins the outer surface of leg 24 in a smooth curve that has approximately the same radius of curvature as the curved surface 26 until it straightens out and reaches the butt portion 28 which is comprised of two surfaces meeting at an angle which is preferably 90° or slightly obtuse.

In the non-assembled state, i.e., when the resilient element is not located in a groove, the legs 23 and 24 extend outwardly and spread apart of each other until, preferably, they have the same length, as diagrammatically shown in FIG. 5.

Figure 6:
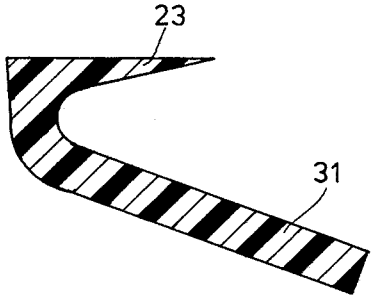
FIG. 6 is a side view of the embodiment of FIG. 4 in the direction of the arrow P.

Short radial projections 29 and 30 are provided at the extreme free ends of the "three"-shaped sealing elements 22, 32. As can be seen from FIG. 6, the cross-section of the remainder of the sealing element with the main difference being that the lower quadrilateral-shaped leg 31 is longer than the wedge-shaped leg 23.

Figure 3:
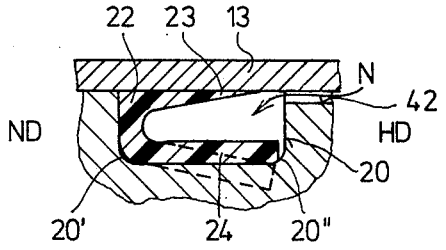
FIG. 3 is an enlarged, partial view in cross-section of a detail of the arrangement of FIG. 1.

In the assembled condition shown in FIG. 3, the upper planar surface of the tapered leg 23 abuts flush against the cover 13, for example, whereas the lower planar surface of the quadrilateral-shaped leg 24 abuts against the base wall of the groove 20. The legs of the element 22 are urged towards each other so that each lie in approximately mutually parallel planes; i.e., from the dashed line position towards the full line position, when the cover 13 is bolted to the housing due to the inherent resilience of the material of the sealing element itself. A slight sealing force is thus exerted by the legs of the sealing element on the bearing members 14–17 and on the covers of the housing so that the bearing members 14–17 are lightly urged against the surfaces of the gears.

A fluid-admitting inlet port 33 and a fluid-discharging outlet port 34 communicate, from below and above, with the region of the chamber 11 where the gears 18, 19 mesh. The chamber 11 includes a portion or zone 43 which is adjacent to one of the ports, e.g. outlet port 34, and wherein the pressure of fluid is relatively high when the gears rotate and fluid is admitted into the chamber. If the machine is used as a pump, the high pressure zone is adjacent to the outlet port 34. If the machine is used as a motor, the high pressure zone is adjacent to the inlet port 33.

In operation as a pump, for example, the inlet port 33 is connected to a source of fluid which is at a relatively low pressure. As the gears are rotated by the prime mover, a pressure force is generated by the rotating gears so that a high pressure zone 43 exists within the chamber adjacent the outlet port 34. This difference in pressure above and below the gears 18 and 19 causes the latter to be pushed downwardly to form a metallic seal with the housing.

A passage 42 is provided in the housing, and preferably in the bearing members 14–17 for permitting communication between the high pressure zone 43 and the interior of the groove 20. Thus, the force exerted by the pressure fluid entering the open side of the sealing element 22 which faces the passage 43 will be directed in the direction of the arrow labeled N in FIG. 3 from the high pressure side HD towards the lower pressure side ND of the housing. This fluid which enters at a higher pressure will flow into the open end of the sealing element in a smooth, laminar fashion due to the fact that the leg 23 is linearly tapered and therefore does not subject the entering fluid to any turbulence-causing obstructions. The magnitude of the force generated thereby depends upon the loading of the machine; thus, the entering fluid will tightly and reliably press the wedge-shaped leg 23 against the housing cover 13, as well as to press the quadrilateal-shaped leg 24 against the interior walls of the groove 20.

Figure 7:
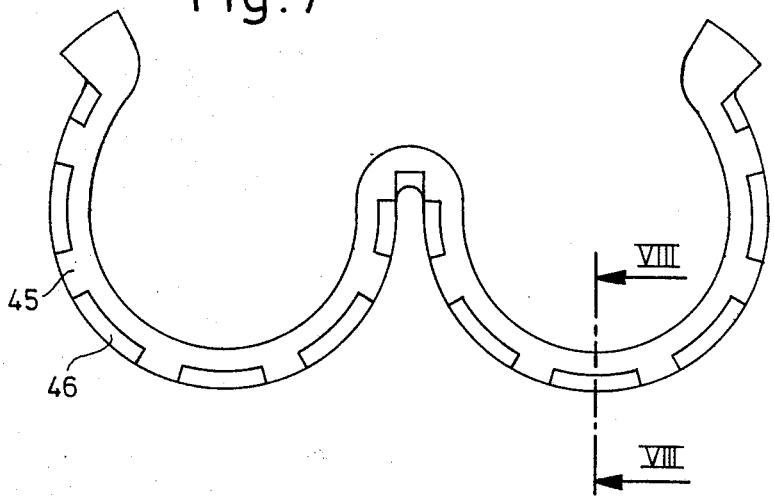
FIG. 7 is a top view of another embodiment of the sealing element in accordance with the present invention.
Figure 8:
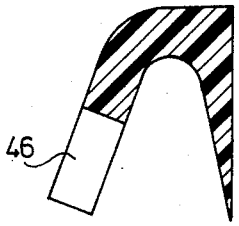
FIG. 8 is a view in cross-section of the sealing ring of FIG. 7 along the line in the direction of the arrows VIII—VIII.

In order to still further improve the sealing capability of the machine, the invention further comprises providing notches or cutouts 46 along the elongation of the three-shaped outline of the sealing element 45 of FIGS. 7 and 8.

Figure 9:
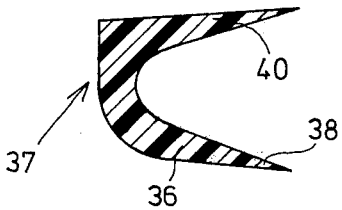
FIG. 9 is a view in cross-section of still another embodiment of the sealing ring in accordance with the present invention.
Figure 10:
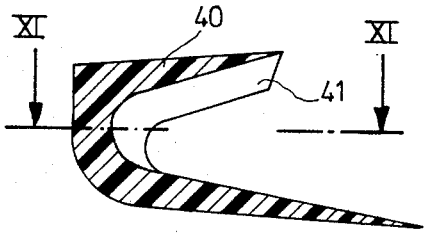
FIG. 10 is a side view of an additional modification of the embodiment of FIG. 9.
Figure 11:
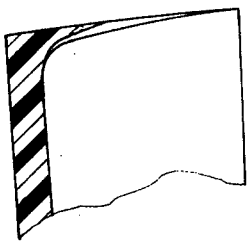
FIG. 11 is a sectional view of the sealing ring of FIG. 10 along the line in the direction of the arrows XI—XI.

In the embodiment of FIGS. 9–11, the sealing element 37 generally corresponds to the embodiments previously discussed, except for the fact that the lower leg 36 which, in previous embodiments, was quadrilaterally-shaped, now is provided with a wedge-like configuration which tapers to a point 38 and which is substantially similar to its upper leg 40.

The sealing element 37 can also be provided with short, radial projections at its outermost free ends, as shown in FIGS. 10 and 11. A side view of such projections illustrates, in a preferred embodiment, that the upper leg 40 has a portion 41 which extends downwardly to a slight extent towards the lower leg 36 to improve the sealing at these outermost ends. This embodiment facilitates a more precise accommodation of the sealing element in its groove.

It is preferable if the sealing element consists of any synthetic plastic material as, for example, polyamides such as nylon, or any glass-fiber reinforced synthetic plastic material, just to mention a few possibilities.

It will be understood that each of the elements described above, or two or more together, may also find a useful application in other types of constructions differingg from the types described above.

While the invention has been illustrated and described as embodied in a sealing arrangement for gear-type fluid displacing machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a gear-type fluid displacing machine, a combination comprising a housing having a chamber and two side sections overlying opposite ends of the chamber; a pair of mating gears in said chamber for generating as they rotate a pressure area therein whose magnitude depends upon the loading and rotational speed of said gears, said gears having adjacent trunnions at said opposite ends of said chamber; annular bearing members surrounding said trunnions and each having an end facing one of said side sections and formed with a groove; and generally U-shaped resilient means in each of said grooves for sealing the latter as a function of the prevailing loading condition, said sealing means having legs which respectively engage one of said grooves and said side section which faces the latter in prestressed condition for normally sealing said grooves under no-load and slightly-loaded conditions due to the inherent resilience of said legs, and said legs in part bounding a space which is in communication with said pressure area so that under higher-loaded conditions said legs are pressed more firmly into sealing engagement therewith under the influence of pressure fluid entering from said pressure area into said space of said sealing means due to the increased magnitude of the force exerted by the pressure fluid entering from said pressure area under increased loading, whereby said grooves are sealed with different magnitudes of force which depend upon the prevailing loading condition.

2. The combination as defined in claim 1, wherein one of said legs has a quadrilateral-shaped configuration and a thickness which is relatively greater than the thickness of another one of said legs.

3. The combination as defined in claim 1, said legs having respective normally-extended lengths which are substantially equal.

4. The combination as defined in claim 1, wherein each of said grooves bounds a generally quadrilateral-shaped cavity with the respective one of said side sections, said groove having a base wall and side walls which meet said base wall at rounded corners.

5. The combination as defined in claim 1, wherein each leg has a wedge-shaped configuration which tapers to a point.

6. The combination as defined in claim 1, wherein said seating means is of synthetic plastic material selected from the group of polyamides.

7. The combination as defined in claim 1, wherein said sealing means of glass-fiber-reinforced synthetic plastic material.

8. The combination as defined in claim 1, wherein said pressure area is located in said chamber; and further comprising a passage located on said bearing members and being in communication with said pressure area and with said space for permitting the entry of said pressure fluid towards the latter.

9. The combinations as defined in claim 1, wherein said sealing means has a configuration which corresponds to the outline of the numeral 3, and wherein said sealing means has radially-extending projections at the free end regions of the three-shaped outline.

10. The combination as defined in claim 9, wherein one of said legs has a quadrilateral-shaped configuration; and further comprising a plurality of notches spaced one the elongation of said other leg.

11. The combination as defined in claim 9, wherein said projections comprise a first wedge-shaped leg portion having a first length, and a second wedge-shaped leg portion having a second length, said second length being longer than said first length.

12. The combination as defined in claim 9, wherein each of said radially-extending projections has an extension portion which extends in part towards the interior of said U-shaped sealing means.

13. The combination as defined i claim 1, wherein said sealing means comprises a sealing element having a closed side and an open side, and wherein one of said legs is linearly tapered from said closed side towards said open side of said element.

14. The combination as defined in claim 13, wherein said one leg is wedge-shaped.

15. The combination as defined in claim 13, wherein the other of said legs is connected to said one leg at said closed side, said legs forming a predetermined acute angle with each other, and wherein said closed side has a curved inner surface for smoothly joining said legs to each other.

16. The combination as defined in claim 15, wherein said one leg further comprises a butt portion, and wherein said closed side comprises a curved outer surface for smoothly joining said other leg to said butt portion of said one leg.

17. In a gear-type fluid displacing machine, a combination comprising a housing having a chamber and two side sections overlying opposite ends of the chamber; a pair of mating gears in said chamber for generating a high pressure area therein as they rotate, said gears having adjacent trunnions at said opposite ends of said chamber; annular bearing members surrounding said trunnions and each having an end facing one of said side sections and formed with a groove; a generally U-shaped resilient sealing element in each of said grooves and having a configuration which corresponds to the outline of the numeral three, said element including radially-extending projections at the free end regions of the three-shaped outline, said element further including an open side in communication with said high pressure area and at least one wedge-shaped leg pressed into sealing contact with an associated side section by its own resilience and by the force exerted by the pressure fluid entering said open side from said high pressure area, and another leg of quadrilateral-shaped configuration; and a plurality of notches spaced along the elongation of said other leg.

18. In a gear-type fluid displacing machine, a combination comprising a housing having a chamber and two side sections overlying opposite ends of the chamber; a pair of mating gears in said chamber for generating a high pressure area in said chamber as they rotate, said gears having adjacent trunnions at said opposite ends of said chamber; annular bearing members surrounding said trunnions and each having an end facing one of said side sections and formed with a groove; a generally U-shaped resilient sealing element in each of said grooves and having an open side in communication with said high pressure area, said element having at least one wedge-shaped leg pressed into sealing contact with an associated side section by its own resilience and by the force exerted by the pressure fluid entering said open side from said high pressure area; and a passage located on said bearing members and being in communication with said high pressure area and with said open side of said element for permitting the entry of said pressure fluid towards the latter.

* * * * *